US006732748B2

(12) United States Patent
Kahre et al.

(10) Patent No.: US 6,732,748 B2
(45) Date of Patent: May 11, 2004

(54) CLEAR RINSING AGENTS

(75) Inventors: Joerg Kahre, Leichlingen (DE); Michael Elsner, Helligenhaus (DE); Rita Koester, Duesseldorf (DE); Karl Heinz Schmid, Mettmann (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 10/182,288

(22) PCT Filed: Jan. 19, 2001

(86) PCT No.: PCT/EP01/00612

§ 371 (c)(1),
(2), (4) Date: Nov. 25, 2002

(87) PCT Pub. No.: WO01/55288

PCT Pub. Date: Aug. 2, 2001

(65) Prior Publication Data

US 2003/0139306 A1 Jul. 24, 2003

(30) Foreign Application Priority Data

Jan. 28, 2000 (DE) ..... 100 03 809

(51) Int. Cl.[7] ..... C11D 1/722; C11D 3/37; C11D 3/22; B08B 3/04

(52) U.S. Cl. ..... 134/25.2; 134/25.3; 134/39; 134/40; 134/42; 510/220; 510/356; 510/360; 510/421; 510/422; 510/470; 510/475; 510/505; 510/506; 510/514; 510/524

(58) Field of Search ..... 510/220, 356, 510/360, 421, 422, 470, 475, 505, 506, 514, 524; 134/25.2, 25.3, 39, 40, 42

(56) References Cited

U.S. PATENT DOCUMENTS 5,759,987 A * 6/1998 Haerer et al. ..... 510/514

FOREIGN PATENT DOCUMENTS

| | | |
|---|---|---|
| DE | 24 32 757 | 1/1976 |
| DE | 43 23 252 | 1/1995 |
| DE | 197 38 866 | 3/1999 |
| DE | 198 51 453 | 5/2000 |
| WO | WO 96/12001 | 4/1996 |
| WO | WO 99/10458 | 3/1999 |
| WO | WO 99/27047 | 6/1999 |
| WO | WO 00/50549 | 8/2000 |

OTHER PUBLICATIONS

M. Biemann "Alkylpolyglucoside–Technologie und Eigenschaften" Starch/Starke 45 (1993) Nr. 8 pp. 281, 284–288 NMG; 47.

B. Salka "Alkyl Polyglycosides Properties and Applications" Cosmetics and Toiletries vol. 108, Mar. 1993, pp. 89–94.

J. Kahne et al. "Alkylpolyglucoside–Eln neues Konzapt für Pflege und Verträglich–keit in der Kosmetik", SOFW–Journal, 121, Jahrgang, 8/95, Aug. 1995; NJ.

* cited by examiner

*Primary Examiner*—Brian P. Mruk
(74) *Attorney, Agent, or Firm*—John E. Drach; Steven J. Trzaska

(57) ABSTRACT

A rinse aid composition containing: (a) a hydroxy mixed ether corresponding to formula I:

$$R^1O[CH_2CHR^2O]_x[CH_2CHR^3O]_yCH_2CH(OH)R^4 \quad (I)$$

wherein $R^1$ is an alkyl and/or alkenyl group containing from about 4 to 22 carbon atoms, $R^2$ is hydrogen or a methyl or an ethyl group, $R^3$ is hydrogen or a methyl or an ethyl group, $R^4$ is an alkyl group containing from about 2 to 22 carbon atoms, x is a number up to 30, y is a number up to 30, and x+y is greater than or equal to 1; (b) an alkyl and/or alkenyl oligoglycoside corresponding to formula II:

$$R^5O—[G]_p \quad (II)$$

wherein $R^5$ is an alkyl and/or alkenyl group containing from about 4 to 22 carbon atoms, G is a sugar unit containing 5 or 6 carbon atoms, and p is a number from 1 to 10; and (c) a nonionic co-surfactant, and wherein (a) and (b) are present in the composition in a ratio by weight of from about 10:0.1 to 1:10.

22 Claims, No Drawings

CLEAR RINSING AGENTS

FIELD OF THE INVENTION

This invention relates to rinse agents for dishwashing machines containing hydroxy mixed ethers and alkyl and/or alkenyl oligoglycosides, optionally other nonionic surfactants, water and other auxiliaries and additives, to the use of such mixtures in rinse agents and to a process for rinsing and cleaning hard surfaces.

PRIOR ART

Today, machine-washed tableware has to meet stricter requirements than hand-washed tableware. Thus, even tableware completely free from food residues is regarded as unsatisfactory when, after dishwashing, it still has whitish stains which are attributable to water hardness or other mineral salts and which come from water droplets that have remained on the tableware through lack of wetting agent and dried.

Accordingly, to obtain bright, spotless tableware, rinse agents have to be used. The addition of liquid or solid rinse agent ensures that the water drains completely from the tableware so that the various surfaces are bright and free from residues at the end of the dishwashing program.

Commercially available rinse agents are mixtures of nonionic surfactants, solubilizers, organic acids and solvents, water and optionally preservative and perfumes. The function of the surfactants in these compositions is to influence the interfacial tension of the water in such a way that it is able to drain from the tableware as a thin, coherent film so that no droplets of water, streaks or films remain behind during the subsequent drying process (so-called wetting effect). Another function of the surfactants is to suppress the foam generated by food residues in the dishwashing machine. Since the rinse agents generally contain acids to improve the clear drying effect, the surfactants used also have to be relatively hydrolysis-resistant towards acids.

Rinse agents are used both in the home and in the institutional sector. In domestic dishwashers, the rinse agent is added after the prerinse and wash cycle at 40 to 65° C. Institutional dishwashers use only one wash liquor which is merely replenished by addition of the rinse agent solution from the preceding wash cycle. Accordingly, there is no complete replacement of water in the entire dishwashing program. Because of this, the rinse agent is also expected to have a foam-suppressing effect, to be temperature-stable in the event of a marked drop in temperature from 85 to 35° C. and, in addition, to be satisfactorily resistant to alkali and active chlorine.

It is known from hitherto unpublished DE 19851453 that alkoxylated fatty acid lower alkyl esters and in particular mixtures with other nonionic surfactants, such as hydroxy mixed ethers and alkyl and/or alkenyl oligoglycosides, satisfy the performance requirements a commercial product is expected to meet. However, no preferred mixing ratios of hydroxy mixed ethers and alkyl and/or alkenyl oligoglycosides are disclosed in that document.

DE-A 19738866 describes surfactant mixtures of hydroxy mixed ethers and nonionic surfactants, such as optionally end-capped fatty alcohol polyethylene glycol/polypropylene glycol ethers, which have favourable foaming behavior and show good clear rinse effects in rinse agents.

The problem addressed by the present invention was to provide rinse agents which, at one and the same time, would show favorable drainage behavior through improved wetting behavior, would have a foam-suppressing effect and would be distinguished by high material compatibility and in particular by very good plastic compatibility of the rinsed surfaces.

The problem stated above has been solved by a combination of hydroxy mixed ethers and alkyl and/or alkenyl oligoglycosides in the ratio by weight according to the invention. High plastic compatibility and—through the very favorable wetting behavior—a spotless shine of the surfaces to be rinsed are obtained in this way. It should be emphasized that the rinse agents according to the invention generate little foam of their own despite the alkyl and/or alkenyl oligoglycosides which are known to be highly surface-compatible, but have no foam-suppressing effect. It has also been found that the use of the petrochemical solubilizer, cumenesulfonate, can be reduced by up to 75% through the use of hydroxy mixed ethers, particularly in combination with alkyl and/or alkenyl oligoglycosides.

DESCRIPTION OF THE INVENTION

The present invention relates to rinse agents containing a. hydroxy mixed ethers (HMEs) corresponding to formula (I):

$$R^1O[CH_2CHR^2O]_x[CH_2CHR^3O]_yCH_2CH(OH)R^4 \quad (I)$$

in which $R^1$ is an alkyl and/or alkenyl group containing 4 to 22 carbon atoms,
$R^2$ is hydrogen or a methyl or ethyl group,
$R^3$ is hydrogen or a methyl or ethyl group,
$R^4$ is an alkyl group containing 2 to 22 carbon atoms,
x=0 or 1 to 30,
y=0 or 1 to 30, x+y>=1, b. alkyl and/or alkenyl oligoglycosides (APGs) corresponding to formula (II):

$$R^5O—[G]_p \quad (II)$$

in which $R^5$ is an alkyl and/or alkenyl group containing 4 to 22 carbon atoms,
G is a sugar unit containing 5 or 6 carbon atoms,
p is a number of 1 to 10, c. other nonionic surfactants, d. optionally water, e. optionally auxiliaries and additives, HMEs and APGs being present in the rinse agents in a ratio by weight of 10:0.1 to 1:10.

Hydroxy Mixed Ethers

Hydroxy mixed ethers corresponding to formula (I) are known from the literature and are described, for example, in German patent application DE 19738866. They are prepared by reaction of 1,2-epoxyalkanes ($R^4CHOCH_2$), where $R^4$ is an aliphatic saturated, linear or branched alkyl group containing 2 to 22 and more particularly 6 to 16 carbon atoms, with alkoxylated alcohols. Hydroxy mixed ethers preferred for the purposes of the invention are those derived from alkoxylates of monohydric alcohols with the formula $R^1$—OH containing 4 to 18 carbon atoms, $R^1$ being an aliphatic, saturated, linear or branched alkyl group, more particularly containing 6 to 16 carbon atoms. Examples of suitable straight-chain alcohols are butan-1-ol, caproic alcohol, oenanthic alcohol, caprylic alcohol, pelargonic alcohol, capric alcohol, undecan-1-ol, lauryl alcohol, tridecan-1-ol, myristyl alcohol, pentadecan-1-ol, palmityl alcohol, heptadecan-1-ol, stearyl alcohol, nonadecan-1-ol, arachidyl alcohol, heneicosan-1-ol, behenyl alcohol and the technical mixtures thereof obtained in the high-pressure hydrogenation of technical methyl esters based on fats and oils. Examples of branched alcohols are so-called oxo alcohols which generally contain 2 to 4 methyl groups as branches and are produced by the oxo process and so-called Guerbet alcohols which are branched in the 2-position by an alkyl group. Suitable Guerbet alcohols are 2-ethyl hexanol, 2-butyl octanol, 2-hexyl decanol and/or 2-octyl dodecanol.

The alcohols are used in the form of their alkoxylates which are prepared in known manner by reaction of the alcohols in any order with ethylene oxide, propylene oxide and/or butylene oxide. Alkoxylates of alcohols formed by reaction with 10 to 50 mol ethylene oxide ($R^2$ and $R^3$=hydrogen and x+y=1–50) are preferably used. Both alkoxylates obtained by reaction of alcohol with 1 to 10 mol propylene oxide ($R^2$=methyl, x=1–10) and 10 to 30 mol ethylene oxide ($R^3$=hydrogen, y=10–30) and those obtained by reaction of alcohol with 10 to 30 mol ethylene oxide ($R^2$=hydrogen, x=10–30) and 1 to 10 mol propylene oxide ($R^3$=methyl, y=1–10) are preferred.

Particularly suitable hydroxy mixed ethers are those corresponding to formula (I), where $R^2$ is a methyl group and $R^3$ is hydrogen, which have advantageously been produced by reaction of alcohol with 1 to 3 mol propylene oxide (x=1–3) and then with 10 to 25 mol ethylene oxide (y=10–25).

Alkyl and/or Alkenyl Oligoglycosides

The rinse agents according to the invention contain alkyl and/or alkenyl oligoglycosides corresponding to formula (II) as compulsory components. They may be obtained by the relevant methods of preparative organic chemistry. The synoptic articles by Biermann et al. in Starch/Stärke 45, 281 (1993), B. Salka in Cosm. Toil. 108, 89 (1993) and J. Kähre et al. in SÖFW-Journal, No. 8, 598 (1995) are cited as representative of the extensive literature available on the subject.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides.

The alkyl group $R^5$ may be derived from primary saturated alcohols. Typical examples are butan-1-ol, caproic alcohol, oenanthic alcohol, caprylic alcohol, pelargonic alcohol, capric alcohol, undecan-1-ol, lauryl alcohol, tridecan-1-ol, myristyl alcohol, pentadecan-1-ol, cetyl alcohol, palmityl alcohol, heptadecan-1-ol, stearyl alcohol, isostearyl alcohol, nonadecan-1-ol, arachidyl alcohol, heneicosan-1-ol and behenyl alcohol and the technical mixtures thereof obtained, for example, in the hydrogenation of technical fatty acid methyl esters or in the hydrogenation of aldehydes from Roelen's oxo synthesis.

The alkenyl group $R^5$ may be derived from primary unsaturated alcohols. Typical examples of unsaturated alcohols are undecen-1-ol, oleyl alcohol, elaidyl alcohol, ricinolyl alcohol, linoleyl alcohol, linolenyl alcohol, gadoleyl alcohol, arachidonyl alcohol, erucyl alcohol, brassidyl alcohol, palmitoleyl alcohol, petroselinyl alcohol, arachyl alcohol and the technical mixtures thereof obtainable in the manner described above.

Alkyl or alkenyl groups $R^5$ derived from primary $C_{6-16}$ alcohols are preferred. Alkyl oligoglucosides having a chain length of $C_8$ to $C_{10}$, which are obtained as first runnings in the separation of technical $C_{8-18}$ coconut fatty alcohol by distillation and which may contain less than 6% by weight of $C_{12}$ alcohol as an impurity, and also alkyl oligoglucosides based on technical $C_{9/11}$ oxoalcohols are preferred. In addition, the alkyl or alkenyl group $R^5$ may also be derived from primary alcohols containing 12 to 14 carbon atoms.

The index p in general formula (II) indicates the degree of oligomerization (DP), i.e. the distribution of mono- and oligoglycosides, and is a number of 1 to 10. Whereas p in a given compound must always be an integer and, above all, may assume a value of 1 to 3, the value p for a certain alkyl oligoglycoside is an analytically determined calculated quantity which is generally a broken number. Alkyl and/or alkenyl oligoglycosides having an average degree of oligomerization p of 1.1 to 2.0 are preferably used. Alkyl and/or alkenyl oligoglycosides having a degree of oligomerization of less than 2.0 and, more particularly, between 1.2 and 1.7 are preferred from the applicational point of view.

In a preferred embodiment, hydroxy mixed ethers corresponding to formula (I) and alkyl and/or alkenyl oligoglycosides corresponding to formula (II) are used in a ratio by weight of 10:0.1 to 1:10, preferably 10:0.5 to 1:5 and more particularly 10:1 to 1:4.

Nonionic Surfactants

The rinse agents according to the invention may contain other nonionic surfactants. Typical examples of nonionic surfactants are alkoxylates of alkanols, end-capped alkoxylates of alkanols with no free OH groups, alkoxylated fatty acid lower alkyl esters, amine oxides, alkylphenol polyglycol ethers, fatty acid polyglycol esters, fatty acid amide polyglycol ethers, fatty amine polyglycol ethers, alkoxylated triglycerides, mixed ethers and mixed formals, fatty acid-N-alkyl glucamides, protein hydrolyzates (more particularly wheat-based vegetable products), polyol fatty acid esters, sugar esters, sorbitan esters and polysorbates. If the nonionic surfactants contain polyglycol ether chains, they may have a conventional homolog distribution although they preferably have a narrow homolog distribution.

The other nonionic surfactants are preferably selected from the group consisting of alkoxylates of alkanols, more particularly fatty alcohol polyethylene glycol/polypropylene glycol ethers (FAEO/PO) corresponding to formula (III) or fatty alcohol polypropylene glycol/polyethylene glycol ethers (FAPO/EO) corresponding to formula (IV), end-capped alkoxylates of alkanols, more particularly end-capped fatty alcohol polyethylene glycol/polypropylene glycol ethers or end-capped fatty alcohol polypropylene glycol/polyethylene glycol ethers, and fatty acid lower alkyl esters and amine oxides.

Fatty Alcohol Polyethylene Glycol/Polypropylene Glycol Ethers

A preferred embodiment is characterized by the use of optionally end-capped fatty alcohol polyethylene glycol/polypropylene glycol ethers corresponding to formula (III):

$$R^6O(CH_2CH_2O)_n[CH_2(CH_3)CHO]_mR^7 \quad \text{(III)}$$

in which $R^6$ is an alkyl and/or alkenyl group containing 8 to 22 carbon atoms, $R^7$ is H or an alkyl group containing 1 to 8 carbon atoms, n is a number of 1 to 40, preferably 1 to 30 and more particularly 1 to 15 and m is 0 or a number of 1 to 10.

Fatty Alcohol Polypropylene Glycol/Polyethylene Glycol Ethers

Optionally end-capped fatty alcohol polypropylene glycol/polyethylene glycol ethers corresponding to formula (IV):

$$R^8O[CH_2(CH3)CHO]q(CH_2CH_2O)_rR^9 \quad \text{(IV)}$$

in which $R^8$ is an alkyl and/or alkenyl group containing 8 to 22 carbon atoms, $R^9$ is H or an alkyl group containing 1 to 8 carbon atoms, q is a number of 1 to 5 and r is a number of 0 to 15.

In a preferred embodiment, the rinse agents according to the invention contain fatty alcohol polyethylene glycol/polypropylene glycol ethers corresponding to formula (III) in which $R^6$ is an aliphatic saturated, linear or branched alkyl group containing 8 to 16 carbon atoms, n is a number of 1 to 10, m is 0 and $R^7$ is hydrogen. These compounds (III) are products of the addition of 1 to 10 mol ethylene oxide onto monohydric alcohols. Suitable alcohols are the above-described alcohols, such as fatty alcohols, oxo alcohols and Guerbet alcohols. Other suitable alcohol ethoxylates are those which have a narrow homolog distribution.

Other suitable representatives of non-end-capped representatives are those corresponding to formula (III) in which $R^6$ is an aliphatic, saturated, linear or branched alkyl group containing 8 to 16 carbon atoms, n is a number of 2 to 7, m is a number of 3 to 7 and $R^7$ is hydrogen. These compounds (III) are products of the addition of monohydric alcohols of the type already described alkoxylated first with 2 to 7 mol ethylene oxide and then with 3 to 7 mol propylene oxide.

The end-capped compounds of formula (III) are terminated by a $C_{1-8}$ alkyl group ($R^7$). In the literature, such compounds are also commonly referred to as mixed ethers. Suitable representatives are methyl-group-terminated compounds of formula (III) in which $R^6$ is an aliphatic, saturated, linear or branched alkyl group containing 8 to 16 carbon atoms, n is a number of 2 to 7, m is a number of 3 to 7 and $R^7$ is a methyl group. Compounds such as these may readily be prepared by reacting the corresponding non-end-capped fatty alcohol polyethylene glycol/polypropylene glycol ethers with methyl chloride in the presence of a base.

Suitable representatives of alkyl-group-terminated compounds are those of formula (III), in which $R^6$ is an aliphatic, saturated, linear or branched alkyl group containing 8 to 16 carbon atoms, n is a number of 5 to 15, m is 0 and $R^7$ is an alkyl group containing 4 to 8 carbon atoms. The end capping is preferably carried out with a linear or branched butyl group by reacting the corresponding fatty alcohol polyethylene glycol ether with n-butyl chloride or with tert.butyl chloride in the presence of bases.

Optionally end-capped fatty alcohol polypropylene glycol/polyethylene glycol ethers of formula (IV) may be present instead of or in admixture with the compounds of formula (III). Compounds such as these are described, for example, in DE-A1-43 23 252. Particularly preferred representatives of the compounds of formula (IV) are those in which $R^8$ is an aliphatic, saturated, linear or branched alkyl group containing 8 to 16 carbon atoms, q is a number of 1 to 5, r is a number of 1 to 6 and $R^9$ is hydrogen. Compounds such as these are preferably products of the addition of 1 to 5 mol propylene oxide and 1 to 6 mol ethylene oxide onto monohydric alcohols which have already been described as suitable in connection with the hydroxy mixed ethers.

Alkoxylated Fatty Acid Lower Alkyl Esters

Suitable alkoxylated fatty acid lower alkyl esters are surfactants corresponding to formula (V):

$$R^{10}CO—(OCH_2CHR^{11})_wOR^{12} \quad (V)$$

in which $R^{10}CO$ is a linear or branched, saturated and/or unsaturated acyl group containing 6 to 22 carbon atoms, $R^{11}$ is hydrogen or methyl, $R^{12}$ represents linear or branched alkyl groups containing 1 to 4 carbon atoms and w is a number of 1 to 20. Typical examples are the formal insertion products of on average 1 to 20 and preferably 5 to 10 mol ethylene and/or propylene oxide into the methyl, ethyl, propyl, isopropyl, butyl and tert.butyl esters of caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof. Normally, the products are obtained by insertion of the alkoxides into the carbonyl ester bond in the presence of special catalysts such as, for example, calcined hydrotalcite. Reaction products of on average 5 to 10 mol ethylene oxide into the ester bond of technical coconut fatty acid methyl esters are particularly preferred.

Amine Oxides

Compounds corresponding to formula (VI) and/or (VII):

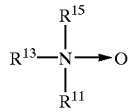

(VI)

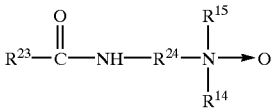

(VII)

may be used as amine oxides. The amine oxides corresponding to formula (VI) are produced by oxidation of tertiary fatty amines having an least one long alkyl chain in the presence of hydrogen peroxide. In the amine oxides of formula (VI) suitable for the purposes of the invention, $R^{13}$ is a linear or branched alkyl chain containing 6 to 22 and preferably 12 to 18 carbon atoms and $R^{14}$ and $R^{15}$ independently of one another have the same meaning as $R^{13}$ or represent an optionally hydroxysubstituted alkyl group containing 1 to 4 carbon atoms. Preferred amine oxides of formula (VI) are those in which $R^{13}$ and $R^{14}$ represent $C_{12/14}$ or $C_{12/18}$ coconut alkyl groups and $R^{15}$ is a methyl or hydroxyethyl group. Other preferred amine oxides of formula (VI) are those in which $R^{13}$ is a $C_{12/14}$ or $C_{12/18}$ coconut alkyl group and $R^{14}$ and $R^{15}$ represent a methyl or hydroxyethyl group. Other suitable amine oxides are alkylamidoamine oxides corresponding to formula (VII) where the alkylamido group $R^{23}CONH$ is formed by the reaction of linear or branched carboxylic acids preferably containing 6 to 22 and more particularly 12 to 18 carbon atoms, more particularly from $C_{12/14}$ or $C_{12/18}$ fatty acids, with amines. $R^{24}$ is a linear or branched alkenyl group containing 2 to 6 and preferably 2 to 4 carbon atoms and $R^{14}$ and $R^{15}$ are as defined for formula (VI).

In a preferred embodiment, the rinse agents according to the invention contain 0.01 to 30% by weight, preferably 0.025 to 20% by weight and more particularly 0.5 to 15% by weight, based on rinse agent, of hydroxy mixed ethers corresponding to formula (I) expressed as active substance (active substance is defined as pure substance present in the rinse agent).

In another embodiment, the rinse agents according to the invention contain 0.01 to 30% by weight, preferably 0.1 to 20% by weight and more particularly 0.2 to 15% by weight, based on rinse agent, of alkyl and/or alkenyl oligoglycosides corresponding to formula (II) expressed as active substance.

The other nonionic surfactants may be present in the rinse agents according to the invention in quantities—expressed as active substance—of 0.1 to 20% by weight, preferably 0.5 to 8% by weight and more particularly 1 to 6% by weight, based on rinse agent.

Water, Auxiliaries and Additives

The rinse agents may be formulated both as aqueous solutions and in solid form, for example encapsulated in wax, or in gel form. In a particularly preferred embodiment, they are aqueous solutions.

The rinse agents according to the invention may contain, for example, solubilizers, such as cumenesulfonate, ethanol, isopropyl alcohol, ethylene glycol, propylene glycol, butyl glycol, diethylene glycol, propylene glycol monobutyl ether, polyethylene or polypropylene glycol ethers with molecular weights of 600 to 1,500,000, preferably with a molecular weight of 400,000 to 800,000, or more particularly butyl diglycol as auxiliaries and additives. In addition, organic acids, such as mono- and/or polybasic carboxylic acids, preferably citric acid, and preservatives and perfumes may be used.

The present invention also relates to the use of hydroxy mixed ethers in combination with alkyl and/or alkenyl oligoglycosides and other nonionic surfactants in rinse agents, preferably for the home and the industrial and institutional sectors.

The present invention also relates to a process for the washing and cleaning of hard surfaces in which the rinse agents according to the invention are applied to the surfaces in admixture with water.

EXAMPLES

Performance tests. Clear rinse behavior is visually determined by examiners. Glasses, cutlery and plates are evaluated in a room with defined lightness. Immersion wetting behavior is also determined (DIN EN 1772).

$$R^1O[CH_2CHR^2O]_x[CH_2CHR^3O]_yCH_2CH(OH)R^4 \quad (I)$$

wherein $R^1$ is an alkyl and/or alkenyl group containing from about 4 to 22 carbon atoms, $R^2$ is hydrogen or a methyl or an ethyl group, $R^3$ hydrogen or a methyl or an ethyl group, $R^4$ is an alkyl group containing from about 2 to 22 carbon atoms, x is a number up to 30, y is a number up to 30, and $x+y \geqq 1$;

(b) an alkyl and/or alkenyl oligoglycoside corresponding to formula II:

$$R^5O—[G]_p \quad (II)$$

wherein $R^5$ is an alkyl and/or alkenyl group containing from about 4 to 22 carbon atoms, G is a sugar unit containing 5 or 6 carbon atoms, and p is a number from 1 to 10; and (c) a nonionic co-surfactant, and wherein (a) and (b) are present in the composition in a ratio by weight of from about 10:01 to 1:10.

2. The composition of claim 1 wherein (a) and (b) are present in the composition in a ratio by weight of from about 10:0.5 to 1:5.

3. The composition of claim 1 wherein in formula I $R^1$ is an alkyl group containing from about 4 to 18 carbon atoms.

4. The composition of claim 1 wherein in formula I $R^2$ is a methyl group end $R^3$ is hydrogen.

5. The composition of claim 1 wherein in formula I x is a number from 1 to 3 and y is a number from 10 to 25.

| | | Composition in % AS active substane | | | | | | |
|---|---|---|---|---|---|---|---|---|
| | | C1 | C2 | C3 | E1 | E2 | E3 | E4 |
| Fatty alcohol alkoxylate | $C_{12/14}$ FA + 5EO + 4PO | 15.00 | 10.50 | — | 8.75 | 8.75 | — | — |
| Hydroxy mixed ether | $C_{8/10}$ FA + 1PO + 22EO $C_{10}$ α-epoxide | — | 4.50 | 15.00 | 3.75 | 3.75 | 12.50 | 12.50 |
| Alkyl polyglucoside | $C_{8/10}$ APG | — | — | — | 2.50 | — | 2.50 | 2.50 |
| Alkyl polyglucoside | $C_{8/16}$ APG | — | — | — | — | 2.50 | — | — |
| Na cumene-sulfonate | | 6.40 | 4.20 | 3.00 | 2.00 | 2.40 | 1.80 | 2.20 |
| Citric acid | | 5.00 | 5.00 | 5.00 | 5.00 | 5.00 | 5.00 | 5.00 |
| Deionized water | | R | R | R | R | R | R | R |
| | pH value | 1.5–2.0 | 1.5–2.0 | 1.5–2.0 | 1.5–2.0 | 1.5–2.0 | 1.5–2.0 | 1.5–2.0 |
| | % total AS | 15.00 | 15.00 | 15.00 | 15.00 | 15.00 | 15.00 | 15.00 |
| | Hydrophilia, concentrate (° C.) | 67 | 67 | 67 | 67 | 67 | 67 | 67 |
| DIN EN 1772 | Immersion wetting power 0.1% AS - 60° C. [secs] | 62 | 50 | 40 | 33 | 30 | 31 | 31 |
| | Clear rinse capacity | Standard | Standard | Standard | Better than standard | | | |
| | Self-foaming behavior (0.2 ml AS) | | | | | | | |
| | Free fall circulation method/40° C./ml foam after 1 min. | 800 | 700 | 600 | 700 | 700 | 650 | 650 |
| | Free fall circulation method/40° C./ml foam after 10 mins. | 650 | 600 | 600 | 700 | 700 | 600 | 600 |
| | Free fall circulation method/40° C./ml foam after 30 mins. | 450 | 450 | 500 | 550 | 500 | 550 | 550 |

We claim:

1. A rinse aid composition comprising:

(a) a hydroxy mixed ether corresponding to formula I:

6. The composition of claim 1 wherein in formula II $R^5$ is an alkyl group containing from about 6 to 16 carbon atoms.

7. The composition of claim 1 wherein in formula II p is a number from 1 to 3.

8. The composition of claim 1 wherein (a) is present in the composition in an amount of from about 0.01 to 30% by weight, based on the weight of the composition.

9. The composition of claim 1 wherein (b) is present in the composition in an amount of from about 0.01 to 30% by weight, based on the weight of the composition.

10. The composition of claim 1 wherein the composition contains from about 0.1 to 20% by weight, based on the weight of the composition, of the nonionic co-surfactant.

11. The composition of claim 1 wherein the nonionic co-surfactant is selected from the group consisting of an alkanol alkoxylate, an end-capped alkanol alkoxylate having no free OH groups, an alkoxylated fatty acid lower alkyl ester; an amine oxide, and mixtures thereof.

12. A process for rinsing a hard surface comprising contacting the surface with an aqueous composition containing:

(a) a hydroxy mixed ether corresponding to formula I:

$$R^1O[CH_2CHR^2O]_x[CH_2CHR^3O]_yCH_2CH(OH)R^4 \quad (I)$$

wherein $R^1$ is an alkyl and/or alkenyl group containing from about 4 to 22 carbon atoms, $R^2$ is hydrogen or a methyl or an ethyl group, $R^3$ is hydrogen or a methyl or an ethyl group, $R^4$ is an alkyl group containing from about 2 to 22 carbon atoms, x is a number up to 30, y is a number up to 30, and $x+y \geqq 1$; and (b) an alkyl and/or alkenyl oligoglycoside corresponding to formula II:

$$R^5O—[G]_p \quad (II)$$

wherein $R^5$ is an alkyl and/or alkenyl group containing from about 4 to 22 carbon atoms, G is a sugar unit containing 5 or 6 carbon atoms, and p is a number from 1 to 10.

13. The process of claim 12 wherein in formula I $R^1$ is an alkyl group containing from about 4 to 18 carbon atoms.

14. The process of claim 12 wherein in formula I $R^2$ is a methyl group and $R^3$ is hydrogen.

15. The process of claim 12 wherein in formula I x is a number from 1 to 3 and y is a number from 10 to 25.

16. The process of claim 12 wherein in formula II $R^5$ is an alkyl group containing from about 6 to 16 carbon atoms.

17. The process of claim 12 wherein in formula II p is a number from 1 to 3.

18. The process of claim 12 wherein (a) is present in the composition in an amount of from about 0.01 to 30% by weight, based on the weight of the composition.

19. The process of claim 12 wherein (b) is present in the composition in an amount of from about 0.01 to 30% by weight, based on the weight of the composition.

20. The process of claim 12 wherein the composition further contains from about 0.1 to 20% by weight, based on the weight of the composition, of a nonionic co-surfactant.

21. The process of claim 20 wherein the nonionic co-surfactant is selected from the group consisting of an alkanol alkoxylate, an end-cupped alkanol alkoxylate having no free OH groups, an alkoxylated fatty acid lower alkyl eater; an some oxide, and mixtures thereof.

22. The process of claim 20 wherein (a) and (b) are present in the composition in a ratio by weight of from about 10:0.5 to 1:5.

* * * * *